US005836839A

United States Patent [19]

Kay

[11] Patent Number: 5,836,839

[45] Date of Patent: Nov. 17, 1998

[54] SLING AND BALL GAME APPARATUS

[76] Inventor: George H. Kay, 1300 Kingston Rd., Mt. Shasta, Calif. 96067

[21] Appl. No.: 988,805

[22] Filed: Dec. 11, 1997

[51] Int. Cl.[6] ..... A63B 67/00

[52] U.S. Cl. ..... 473/511

[58] Field of Search ..... 473/505, 510, 473/511

[56] References Cited

U.S. PATENT DOCUMENTS

| | | | |
|---|---|---|---|
| D. 210,543 | 3/1968 | Nakayama | D21/722 |
| 2,744,354 | 5/1956 | Watkins | 446/255 |
| 2,835,494 | 5/1958 | Hull | 473/511 |
| 3,341,969 | 9/1967 | Olson | 473/511 X |
| 3,724,058 | 4/1973 | Dahl | 473/513 X |
| 4,162,072 | 7/1979 | Schultze et al. | 473/511 |
| 4,194,316 | 3/1980 | Jordon | 446/255 |
| 4,234,183 | 11/1980 | Stephens | 473/505 |
| 4,679,799 | 7/1987 | Coletti | 473/505 |
| 4,938,484 | 7/1990 | Davis, Jr. | 473/511 |
| 5,082,289 | 1/1992 | Paranto | 473/505 |
| 5,301,954 | 4/1994 | Wotring | 473/511 |

*Primary Examiner*—William H. Grieb
*Attorney, Agent, or Firm*—Joseph E. Gerber

[57] ABSTRACT

Game apparatus for tossing and catching a ball includes a sling having a generally rectangular web suspended between a pair of rigid handles. A cord loop runs slidingly through each tubular handle such that when the handles are parallel and drawn apart from one another to the maximum distance the cord loop's length will allow, parallel, first and second taut cord portions run between the first ends of the handles and between the second ends of the handles, respectively. The web is constructed of either foraminous or nonforaminous fabric, and includes hemmed, parallel side edges constructed as tubes through which the parallel cord portions easily slide. A ball approximately the same size and weight as a regulation baseball is used with the embodiment having the nonforaminous web, and a lower-density, sponge rubber ball is used with the foraminous web. The elements described are also presented as a kit for selective use of either web with its respective preferred ball.

34 Claims, 6 Drawing Sheets

SLING AND BALL GAME APPARATUS

BACKGROUND OF THE INVENTION

1. Field Of The Invention

The invention relates generally to ball-toss game apparatus, and more specifically to hand-operated apparatus for tossing and catching a ball for play by one, two or more persons.

2. Description Of The Related Art

A great many different types of game apparatus are known for tossing or launching objects such as balls, and the like. One type of such apparatus is a sling generally comprised of an elongate panel of fabric or net material, with a transverse, rigid handle affixed to each end. Generally, a ball is placed in the center of the panel and the handles are pulled quickly apart, launching the ball. A ball may also be caught with such a sling by placing the panel in the path of the ball's travel, and then, by manipulating the handles, slackening and collapsing the panel around the ball.

Dahl, in U.S. Pat. No. 3,724,058 issued in 1973, shows an example of such a sling comprising a net with handles on its opposed ends, for one-hand or two-hand use. However, the handles of Dahl's device appear pretty close together, which would limit its ability to launch a ball by the user pulling the handles quickly away from one another to make the net suddenly taut. Further, if Dahl's handles are nonparallel when quickly separated, its net does not become uniformly taut. This likely presents problems in getting a ball to eject predictably and accurately from Dahl's net. Finally, as the user grasps and manipulates the end portions of Dahl's handles quite far from the net, rather than grasping portions of the handles which are aligned with the net, it is likely very difficult to separate the handles quickly and forcefully to launch a ball while keeping the net uniformly taut for accuracy.

U.S. Pat. No. 3,341,969 issued to Olson in 1967 shows a disc-shaped spinning toss-toy of the type generally referred to as a "diabolo," wherein handle sticks used for manipulating a string to spin the toy also include a sling-like net between them for catching the spinning toy. Presumably, Olson's net portion could also be used to toss an object such as a ball. However, the structure of Olson's device, especially as it is shown in FIG. 2 thereof, is extremely similar to that in the Dahl Patent. Thus, the device of the Olson would have the same drawbacks as Dahl.

U.S. Pat. No. 4,234,183 issued to Stephens in 1980 shows a ball-tossing sling including a generally rectangular net with a pair of opposed rigid handles. The end edges of Stephens' net are affixed directly to arm members 36 oriented perpendicular to the net's length. Arm members 36 are integral with Stephens' handles, which also include outwardly-angled hand grip portions 27*a*. Stephens' arm members 36 are curved away from the normal plane of the net, thus apparently giving the net a curved cross-section which, along with a hole in the center of Stephens' net, appears calculated to help center a ball for tossing. However, Stephens' device has several drawbacks. One is that Stephens' ball opening 16 is of substantial size, and would likely severely limit the size of the ball or other object able to be cradled in Stephens' net without simply falling through. However, reducing ball opening 16's size would likely reduce its ability to help center the ball in the net.

Further, Stephens' hand grips are angled outward and include finger notches, attempting to fix a comfortable and efficient hand and wrist position for sling-tossing a ball.

However, setting a fixed hand grip angle comfortable for one user may not necessarily be comfortable and accurate for another user. If, in attempting to launch a ball from Stephens' net, the user separates the handles quickly but crookedly, such that Stephens' arm members 36 are not parallel, the net will not become uniformly taut and the ball will be ejected inaccurately. Further, pulling Stephens' handles apart crookedly, with arm members 36 nonparallel, will tend to tear Stephens' net corners away from his arm members.

These problems appear in large part caused by Stephens' securely binding the entire width of his net ends to the arm members 36 of his handles. If Stephens' net were not so bound, curves in arm members 36 and the inclusion of ball opening 16 in the middle of the net would likely be unnecessary.

Thus, scrutiny of the prior art, and especially the Stephens Patent, makes it apparent that there are some subtle but important and heretofore unrecognized factors to be taken into account in constructing a ball-tossing sling that works as well as a mere cursory glance at the concept might cause one to expect. And accordingly, it appears a need exists for a sling-type ball-tossing apparatus able to accommodate different hand and wrist positions without affecting accuracy of the toss and without causing the net or panel to tear away from any structural portion of the apparatus. And, it would be particularly advantageous if the structure thereof were able to able to avoid the complexity and expense of including features such as curved members bound to the end edges of the net and an opening in the middle of the net.

SUMMARY OF THE INVENTION

The sling and ball game apparatus of the present invention is adapted to overcome the above-noted shortcomings and to fulfill the stated needs. The sling portion of the apparatus comprises: first and second elongate, rigid handles; a first cord portion running between first positions on the first and second handles; a second cord portion running between second positions on the first and second handles; a flexible web panel; and, means along first and second elongate edges of the web panel for secure, sliding receipt and retention of the first and second cord portions, respectively.

A kit comprising two handles, a cord loop, a flexible web panel with tubularly-hemmed edges and a ball is also disclosed and claimed.

It is an object of the present invention to provide easily-operable apparatus able to launch and catch a ball or other object.

It is a further object of the present invention to provide ball-toss apparatus which is both simple and inexpensive in its construction, yet durable, versatile and sufficiently adjustable for use by either adults or children, and by persons having differing ability or muscular strength.

Yet another object of this invention is to provide a ball-toss sling having handles which are instantly adjustably positionable during use, without the user having to remove his or her hands from the handles.

Yet a further object of the present invention is to provide a ball-toss sling having a web suspended upon parallel, opposed cord portions, wherein the cord portions do not trap the ball or impede its flight as it is being ejected from the web.

Still a further object of the present invention is to provide a ball-toss sling construction that, with slight modification, may be selectively adapted to tossing either a high-density object or a low-density object.

Another object of the present invention is to provide a ball-toss sling construction including a cord loop that has an easily-released and reattached opening for adjustment of the cord loop's length, and for easy switching between differently-constructed webs for different purposes.

Still further objects of the inventive apparatus disclosed herein will be apparent from the drawings and following detailed description thereof.

DESCRIPTION OF THE PREFERRED EMBODIMENTS

Figure 1:
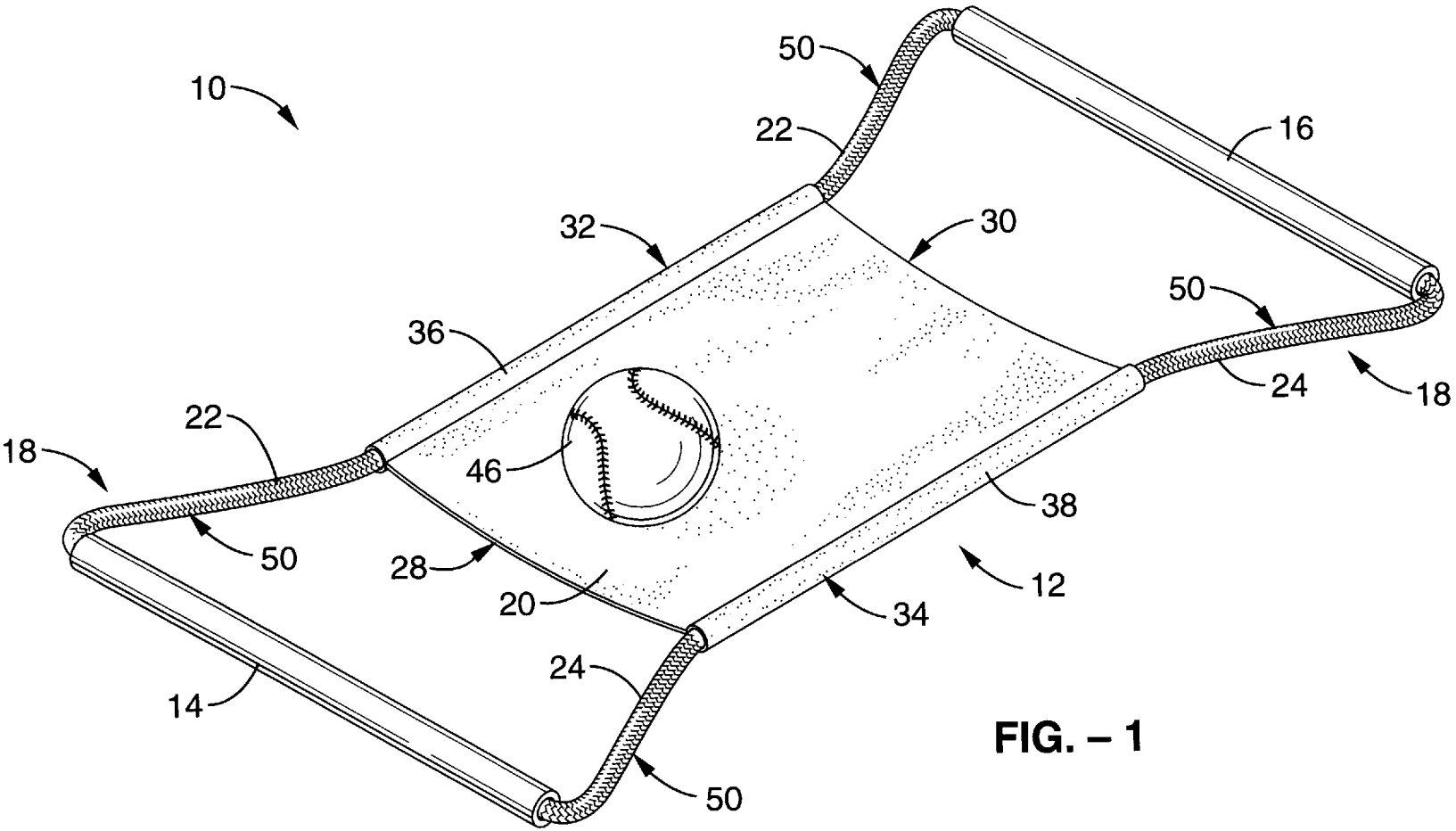
FIG. 1 is a perspective view of a first preferred embodiment of the invention, having a nonforaminous web and being shown with the higher-density ball for which it is best adapted for use.

FIGS. 1 through 4 show a first embodiment of the sling and ball game apparatus of the invention, this first embodiment being generally identified herein with reference numeral 10. The sling portion of the first embodiment, identified with reference numeral 12 herein, includes first and second opposed hollow, rigid handle tubes 14 and 16; a non-resilient cord loop 18 running through and between handle tubes 14 and 16; and, a generally rectangular web panel 20 between opposed first and second parallel portions 22 and 24 of cord loop 18.

Handle tubes 14 and 16 are preferably constructed of rigid tubular material such as PVC pipe. The diameter of handle tubes 14 and 16 is not critical, but should be easily and comfortably grasped and manipulated by the hands of the intended user. A diameter of ⅞" inch, or so, has been found satisfactory for adult use, and may be found acceptable for children, as well. However, smaller diameter handle tubes may be required for some children, just as larger handle tubes may be required for some large or unusually powerful adults.

Whatever their diameter, handle tubes 14 and 16 are preferably uniform in diameter throughout their length, and of sufficient construction to remain substantially rigid during use of the apparatus. For the preferred ⅞" inch outside diameter PVC pipe, for example, the preferred interior diameter is ⅝" inch, or so, thus leaving a wall thickness of ⅛" inch, or so.

The overall lengths of handle tubes 14 and 16 are not critical, although the lengths of both handle tubes 14 and 16 should be identical. The preferred length of both handle tubes 14 and 16 for the version of the apparatus found satisfactory for both children and adults is conveniently 8.5 inches, or so. Shorter or longer handle tubes may be desirable for children or large adults, respectively. And, the user's skill level may affect the handle size chosen. But, as will be discussed further below, the absolute length of handle tubes 14 and 16 is not as critical as the relationship of the length of handle tubes 14 and 16 to the width of web 20.

Cord loop 18 is non-resilient and preferably approximately 70 inches in overall length. Cord loop 18 may be constructed of natural or synthetic, woven or nonwoven rope, cord or string. Woven nylon cord of approximately a 0.25 inch diameter has been found satisfactory. Cord loop 18 is preferably of a single, unitary piece with its ends securely affixed to one another at a knot 26, or the like. Other means for securely, yet releasably, binding the ends of cord loop 18 to one another will be readily apparent to one having ordinary skill in the art. If knot 26 or other means requiring additional length in cord loop 18 are used to bind the ends of cord loop 18 to one another, any such additional length necessary for that purpose should be beyond cord loop 18's 70-inch preferred working length.

Cord loop 18 passes through the interior lumens of both handle tubes 14 and 16, and is able to slide freely therethrough. Knot 26 preferably fits within and through the interior lumens of each handle tube 14 and 16, but preferably does not substantially impair the free sliding movement of cord loop 18 therethrough. When handle tubes 14 and 16 are drawn as far apart as cord loop 18 will allow, the portions of cord loop 18 that run between opposed ends of handle tubes 14 and 16 tend to become substantially parallel. These parallel cord portions are identified with reference numerals 22 and 24 in the drawing figures.

Web 20 is constructed of a generally rectangular piece of textile fabric material. Web 20 has first and second opposed short end edges 28 and 30 and first and second longer, opposed side edges 32 and 34. First and second side edges 32 and 34 are each folded and sewed to define a tubular hem of uniform width along its respective length, said first and second hems being identified herein with reference numerals 36 and 38, respectively. A web 20 approximately 15 inches in length and 8 inches in width, after hemming, was found to work satisfactorily. Strong, but conventional, thread and stitches are used in constructing hems 36 and 38.

Opposed, parallel cord loop portions 22 and 24 run through the opposed, parallel first and second hems 36 and 38 of web 20. Each hem 36 and 38 should be of a sufficient width and interior dimension to permit the 0.25 inch diameter of its respective cord portion 22 or 24 to slide freely therethrough. Thus, web 20 should be able to slide freely side to side along the lengths of cord portions 22 and 24.

For clarity herein and in the claims, references to web 20's length dimension should be construed here to mean distances in the handle-to-handle direction, and web 20's width should be construed to be in the direction between opposed parallel cord portions 22 and 24.

Figure 2:
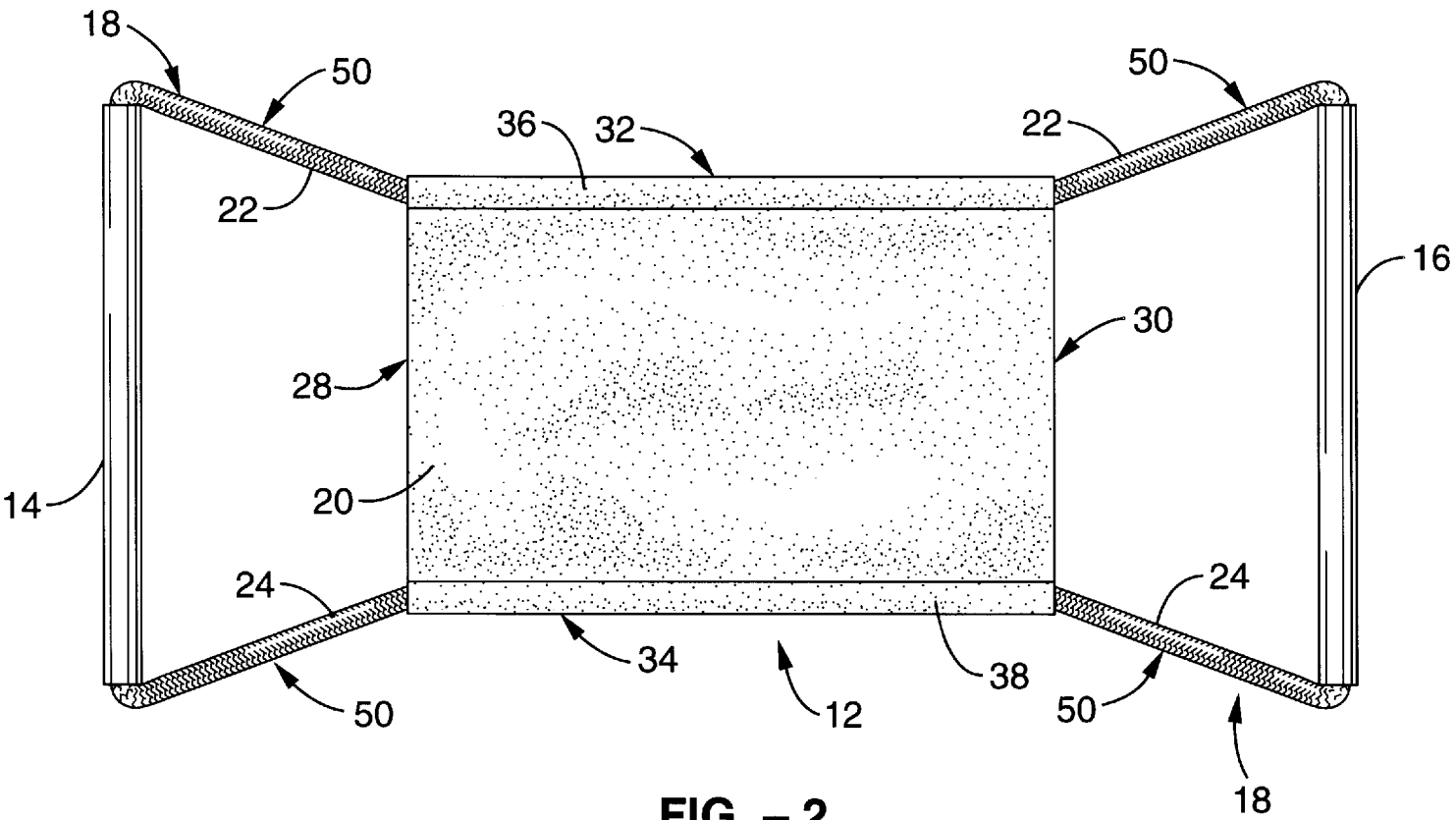
FIG. 2 is a top plan view of the sling portion of the embodiment of the invention shown in FIG. 1, showing the cord loop thereof being pulled fully taut.

Web 20 of sling portion 12 in the first embodiment of the invention may be constructed from a panel of any flexible, durable, nonresilient, nonforaminous material. Natural or synthetic, woven or nonwoven fabrics may suffice, although a woven synthetic such as nylon or polyester is preferred. Such a construction is shown in FIGS. 1 and 2. Single or double layers of material may be used, as needed, to give the apparatus a sufficient useful life. Web 20 is generally rectangular, having a preferred approximate 15-inch length, and a preferred approximate 8-inch width.

Figure 5:
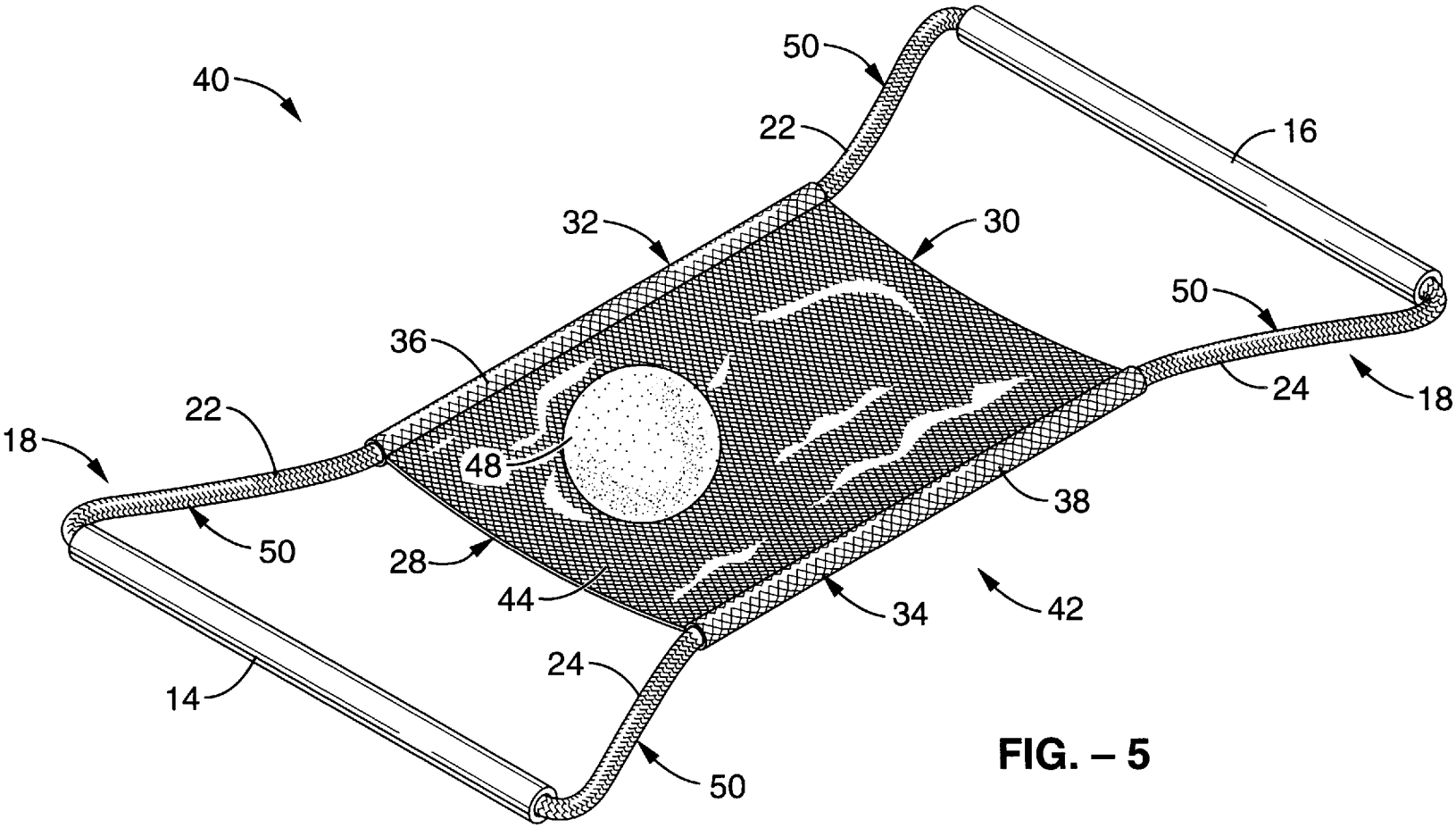
FIG. 5 is a perspective view of a second preferred embodiment of the invention, having a foraminous web and being shown with the lower-density ball for which it is best adapted for use.

The sling portion of a second preferred embodiment of the invention 40 includes an alternative web construction, as shown in FIG. 5. Alternative sling portion 42 includes net-like web 44 which has dimensions similar to those of first web 20. Web 44 is constructed of a panel of single or double layers of durable, flexible, woven netting or some similarly foraminous material. Nylon net material woven of multiple-fiber strands of roughly 1/16 inch width separating roughly 1/4 inch apertures has been found to work satisfactorily in the practice of the second embodiment of the invention. However, other durable, foraminous constructions such as sheets of highly perforated rip-stop nylon with punched-out apertures may also work satisfactorily. The relative benefits of foraminous versus nonforaminous materials for different purposes are discussed further below.

In use, for example with a first embodiment of the inventive apparatus 10 having an 8 by 15-inch web constructed of tightly-woven, nonforaminous material, the user first brings opposed handle tubes 14 and 16 close together allowing web 20 to hang downward in a sling-like posture. A relatively dense ball such as regulation baseball 46, or a ball of similar density and diameter, is then placed in the downward-depending web 20. The user then grasps each handle tube 14 or 16 with one hand and "aims" the apparatus by orienting handle tubes 14 and 16 such that they are generally perpendicular to the direction of intended travel of baseball 46. Then, while keeping this orientation of handle tubes 14 and 16, the user draws handle tubes 14 and 16 quickly apart. This causes cord portions 22 and 24 to become quickly taut, carrying web 20 with them, thus causing baseball 46 to be rapidly ejected from web 20.

Sling portion 10 of the apparatus may also be used to catch a flying ball. This is accomplished by grasping each handle tube 14 and 16 with one hand and placing the sling's web 20 in the path of, and in a plane generally perpendicular to the direction of travel of, ball 24. In awaiting receipt of ball 24, the user must exercise some hand-eye coordination in allowing the flying ball to meet web 20 with web 20 stretched nearly taut. Then, as baseball 46 makes contact with web 20, the user reduces the distance between handle tubes 14 and 16, thus absorbing the momentum of baseball 46 in web 20. Receipt of ball 46 in web 20 causes the fabric of web 20 to bunch up along hems 36 and 38, thus creating a secure pocket in web 20. Further, as handle tubes 14 and 16 are brought closer together, cord portions 22 and 24 converge, drawing the hemmed, elongate side edges 32 and 34 of web 20 over ball 46, thus nesting ball 46 therewithin. This action is reversed as ball 46 is ejected from web 20 upon rapid divergence of handles 14 and 16.

Thus, as the inventive apparatus is adapted to both tossing and catching, a separate unit may be used by each of two or more players, tossing and catching one or more balls between them. Alternatively, a single player beginning with handle tubes 14 and 16 oriented generally horizontally, may engage in solo play by tossing a ball in a vertical direction and catching it as it descends.

Figure 3:
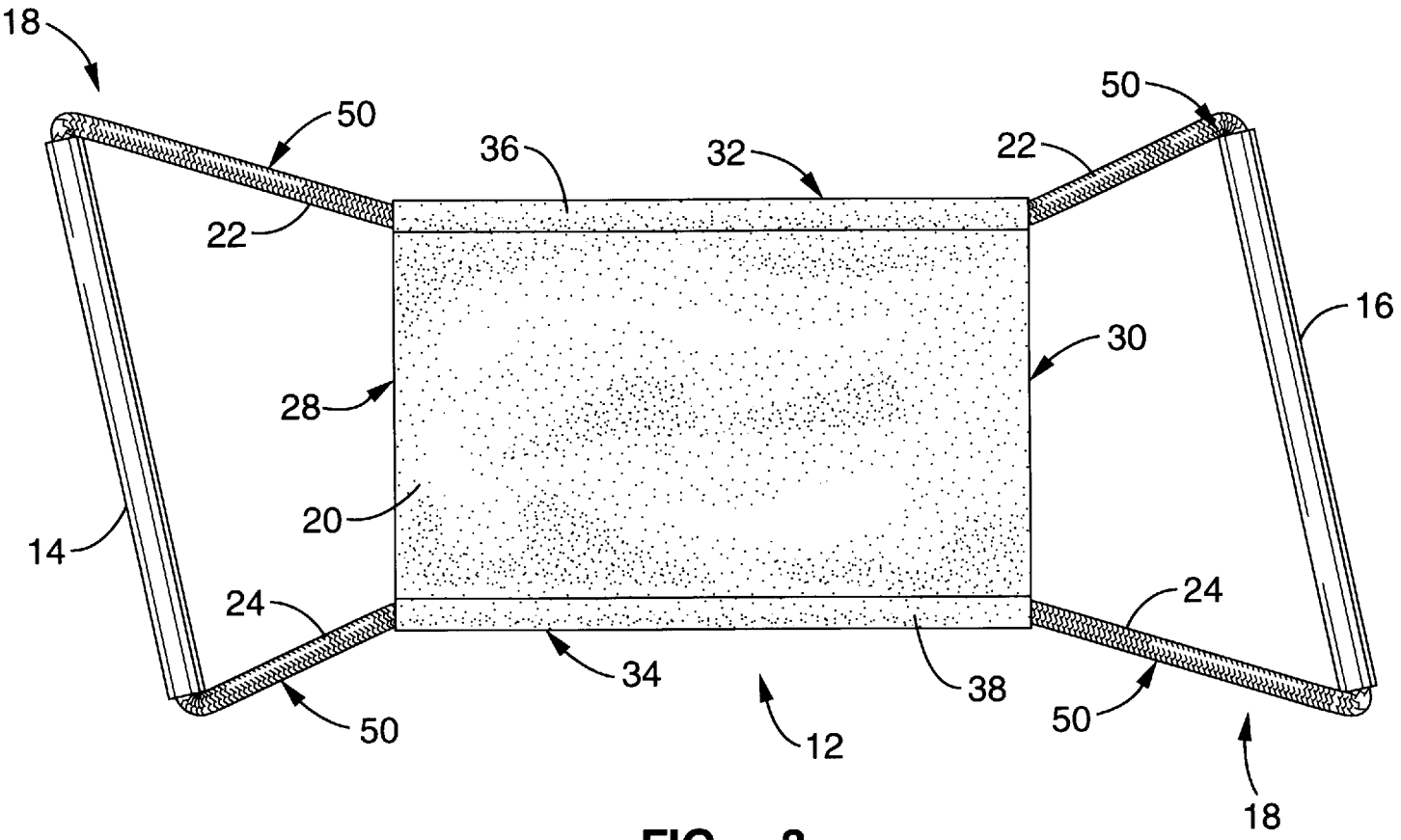
FIG. 3 is a top plan view of the sling portion of the invention adjusted into the configuration of a parallelogram.
Figure 4:
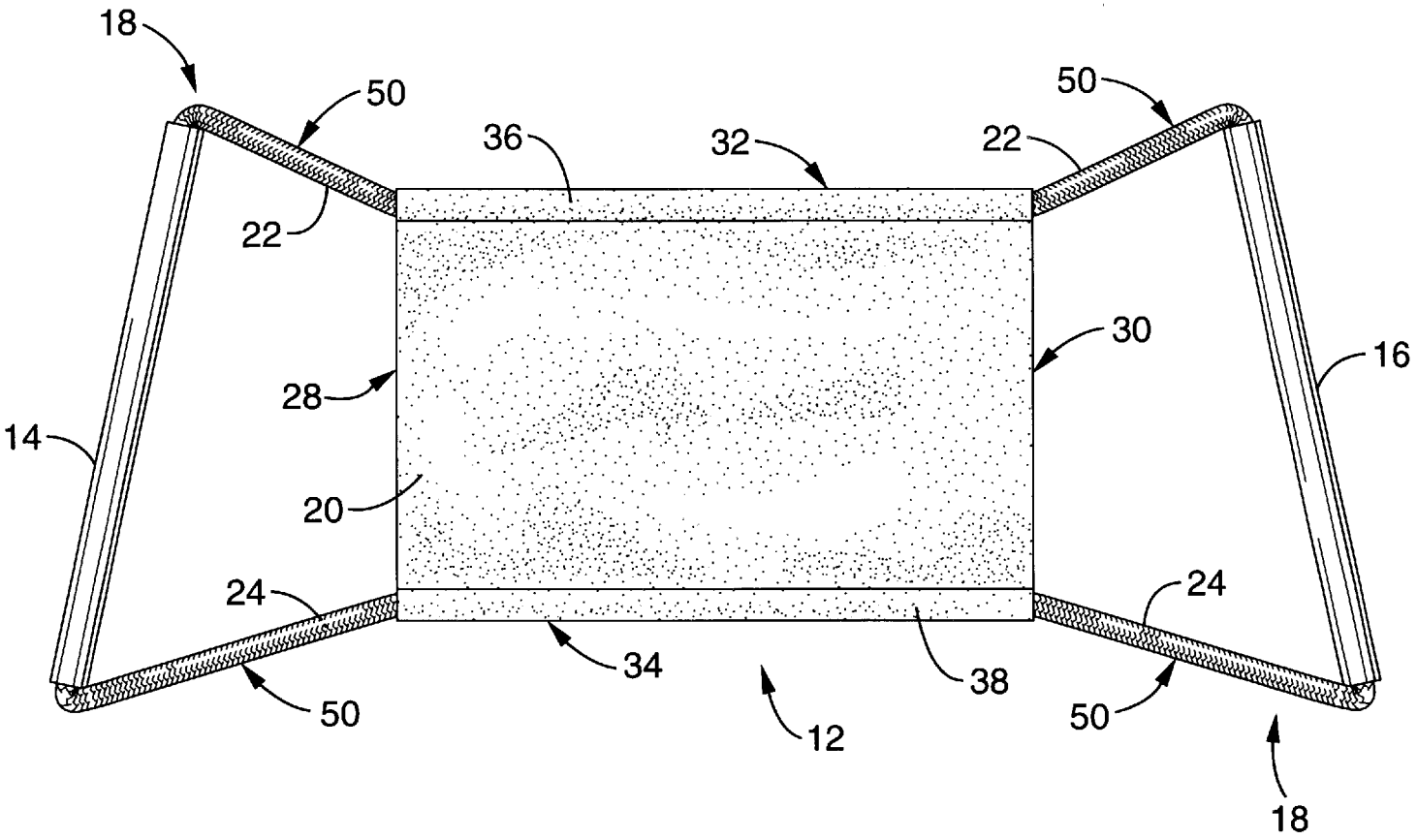
FIG. 4 is a top plan view of the sling portion of the invention adjusted into the configuration of a trapezoid.

The unique construction of the apparatus, with its freely-sliding, circulating cord loop 18 and ample lengths of cord portions 22 and 24 remaining free between web 20's end edges 28 and 30 and the ends of handles 14 and 16, makes it quite versatile in both its adjustability and its manipulability. For example, if the user's size or preference make it desirable to have handles 14 and 16 closer together or farther apart, the length of cord loop 18 may simply be adjusted at knot 26. And, while tossing or catching a ball, handles 14 and 16 need not be kept absolutely parallel. To accommodate the user's grip, wrist position and comfort in different active circumstances, handles 14 and 16 are instantly adjustable on cord loop 18 without the user releasing his or her grasp of the handles. For example, in reaching to one side to catch a ball, the handles may be positioned such that the apparatus is momentarily configured as a parallelogram. This is shown in FIG. 3. Or, in reaching far forward, a trapezoidal shape may result, as shown in FIG. 4. The user must be mindful, however, that when handles 14 and 16 are not parallel to one another and perpendicular to cord loops 24 and 26, web 20 cannot be stretched taut to its maximum extent to prevent trapping or impeding the ball upon launching. Thus, launching is best carried out with the apparatus in a rectilinear configuration.

The aforedescribed first embodiment 10 of the apparatus employing a relatively heavy ball, such as baseball 46, and web 20 constructed of tightly woven, nonforaminous material has been found to work satisfactorily for adult use. In contrast, for child's play it is desirable to use a light-weight, low-density ball, such as may be constructed from styrofoam, low-density sponge rubber, a hollow rubber shell or a light-weight, plastic, Whiffle-type construction. However, it has been found that a tightly-woven, nonforaminous web generates too much wind resistance to launch such a light-weight, low-density ball effectively. This is especially true if the operator of the sling is a child. Therefore, for such use, the second embodiment 40 of the invention is preferred. As shown in FIG. 5, second embodiment 40 includes foraminous web 40 and low-density ball 48. Low-density ball 48 is preferably about the same size as a regulation baseball if the preferred 8 by 15-inch web dimensions are used. And, low-density ball 48 is preferably half, or less than half, the weight of a regulation baseball. Foraminous web 44 of alternative sling 42 creates very little wind resistance as handle tubes 14 and 16 are drawn rapidly in opposite directions, thus permitting low-density ball 48 to reach a sufficient velocity for a flight of significant distance.

Notwithstanding the material of which web 20 is constructed and notwithstanding the overall size of the sling apparatus 12, it is important that a particular relationship be maintained between the length of handle tubes 14 and 16 and the width of web 20. Generally, for purposes and advantages discussed fully below, handle tubes 14 and 16 should be slightly longer than web 20 when web 20 is stretched to its maximum possible width. Specifically, with reference to the preferred dimensions of the embodiments of the invention disclosed above, if web 20 is 8 inches wide when maximally stretched, then handle tubes 14 and 16 should be 8.5 inches long, or so. As cord portions 22 and 24 emerge from and run between first and second ends of handle tubes 14 and 16, respectively, the preferred handle-web length relationship assures that when handle tubes 14 and 16 are pulled apart from one another to the maximum distance the entire length of cord loop 18 will allow, cord portions 22 and 24 will have a tendency to spread apart toward a taut, parallel orientation at a distance equal to the length of handle tubes 14 and 16. This, in turn, causes nonresilient web 20 to be stretched taut to its maximum possible width, that width being slightly less than the distance that would separate first and second cord portions 22 and 24, were web 20 not slightly restricting their travel.

Constructing the apparatus so that web 20's width fails to be slightly shorter than the distance between cord portions 22 and 24 creates a subtle problem that can significantly impair the functionality of the apparatus. This is because, upon the rapid divergence of handle tubes 14 and 16 from one another, which would seem naturally to cause web 20 or 44 to become quickly taut and eject ball 46 or 48 from the web, an interfering action takes place whereby cord portions 22 and 24 resonate in a direction perpendicular to their length. This perpendicular resonation causes the web to close for an instant over the ball. This may or may not completely trap the ball in the web. But, in any case, this resonation of the cord portions which places them briefly in the path of the ball can greatly reduce the speed at which the ball flies out of the web. Thus, it is important that the distance between the ends of handles 14 and 16, and thus between the fully-taut, unencumbered, parallel positions of cord portions 22 and 24, is at least slightly greater than the fully-taut width of web 20 or 44. The more difference there is between the length of handle tubes 14 and 16 and the width of web 20, the more lateral spreading force will be exerted on web 20 as handle tubes 14 and 16 are pulled toward maximally divergent positions.

Experiments indicate that a handle length of at least 0.5 inches greater than the web width is sufficient to eliminate or sufficiently minimize this cord portion resonant interference with the ball's flight when the handles are approximately 8 inches in length. And, a 0.5-inch difference in handle length over web width may prove satisfactory for webs and handles of other dimensions, as well. Differences in handle length to web width greater than 0.5 inches may also yield satisfactory results in assuring unimpeded ejection of the ball from the web, and greater handle length/web width ratios may even improve results, but handles much more than 8.5 inches long used with an 8-inch web tend to tear the web material and hem stitching. Thus, at least a 0.5-inch difference is preferred to avoid impeding ball flight, and a difference of much greater than 0.5 inches is discouraged to prevent structural failure. It may be, however, that stronger material and stitching will permit the use of handles much longer than the widths of the webs with which they are used.

As the preferred embodiments of the invention employ a handle length approximately 0.5 inches, or 6.25%, greater than the web width, it is expected that similar handle length/hem width relationships will apply to the inventive apparatus built in different sizes. And, it is further expected that the acceptable range of handle length to hem width is such that handles approximately 4–10% longer than the hem which with they are used will work satisfactorily.

It should be noted that it is ultimately the distance between parallel cord portions 22 and 24 rather than the handle length, per se, to which the width of web 20 or 44 must be compared. Although in the preferred construction, cord loop 18 circulates through the open ends of handles 14 and 16, these handles could certainly be much longer and could simply include a pair of radial apertures spaced by 8.5 inches through which cord loop 18 could circulate. Alternatively, the handles need not even be tubular; they could be solid, and simply have elongate troughs and a pair of spaced, radial apertures or other means for secure, sliding retention of cord loop 18. Thus, it is the distance between such radial apertures or other retention means which dictates the distance between parallel, taut cord portions 22 and 24, and which dictates, in turn, the maximum width of web 20 or 44. And thus, the distance between taut cord portions 22 and 24 should be approximately 4–10% greater than the width of the web attached thereto. Further, this cord-portion to cord-portion distance used in the comparison to web width is the unencumbered distance between cord portions 22 to 24, i.e. the distance between cord portions 22 and 24 when they are taut and perpendicular to handles 14 and 16, without web 20 or 44 in place.

It should be further noted that too great an angle in the uncovered segments 50 of the cord portions that run between the ends of the web's tubular hems and the ends of the handle tubes may also cause the fabric and stitching of the web to fail after repeated use. Therefore, unless substantial reinforcement is added to the stitching and fabric of the hems of the web, it is best to make sure cord loop 18 is of a sufficient length to leave uncovered segments 50 which are at least 35%, or so, of the length of web 20 or 44, when handles 4–10% longer than the web width are employed. In the preferred embodiments, the uncovered segments 50 are approximately 6 inches long, i.e. about 40% of the length of the web.

It is also contemplated that a sling apparatus not including a freely, slidingly-circulating cord loop, but instead having parallel, taut cord portions fixed in perpendicular relation to opposed handles at a distance slightly greater than the apparatus' web, still falls within the spirit of the invention because such a construction solves, at least, the problem of the ball being trapped or impeded in its flight as it is being ejected from the web.

Figure 6:
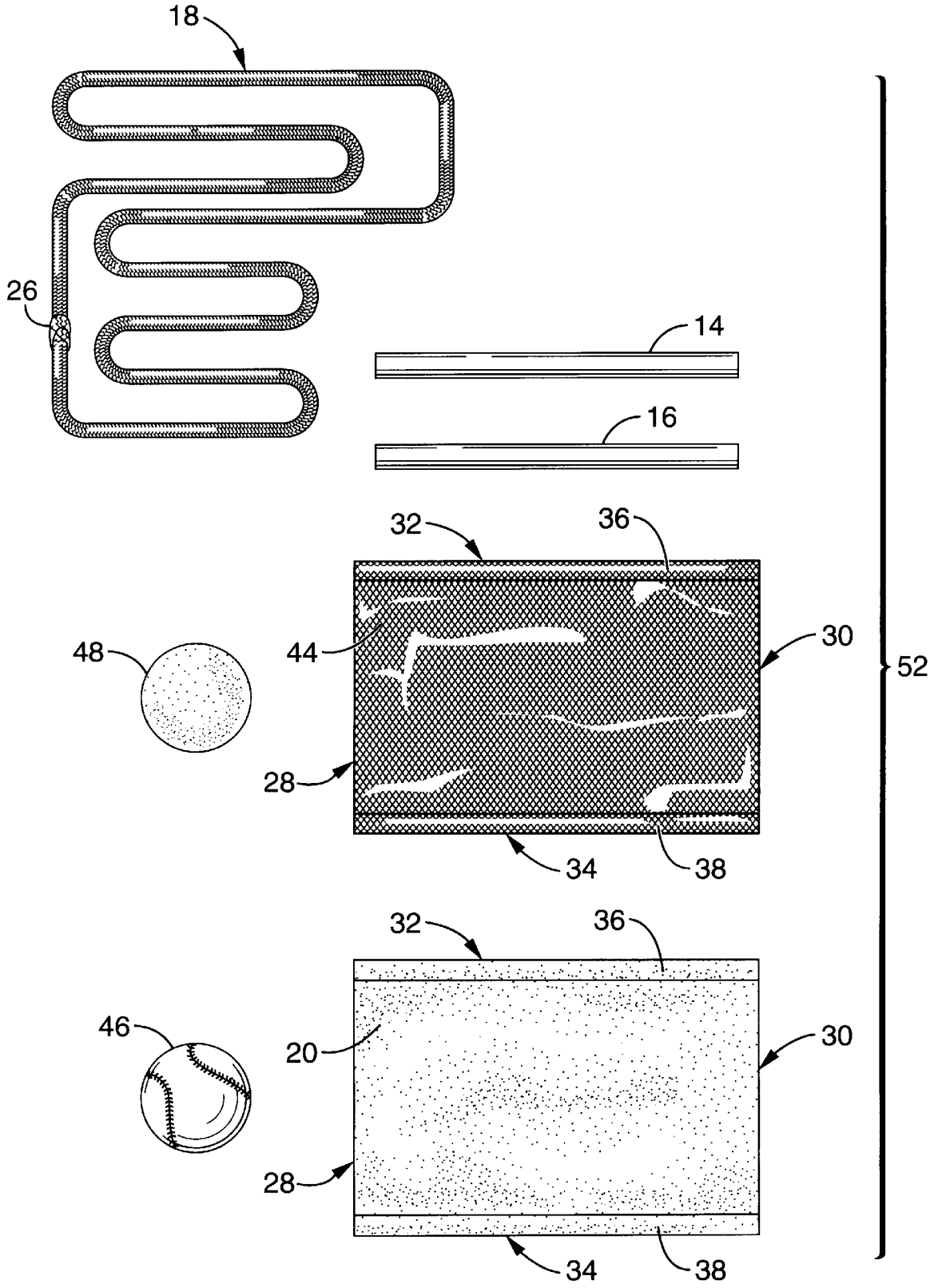
FIG. 6 is a top plan view of kit comprised of the elements necessary for constructing and using the invention.

It is further contemplated that the elements above described may be assembled to form a kit 52 for constructing the ball-toss apparatus of the invention. Such a kit is shown in FIG. 6. and includes, at least, handles 14 and 16; cord loop 18; and, web 20 or 44. Ball 46 or 48, as appropriate for the kit's web, may also be included. A kit providing maximum versatility preferably includes both nonforaminous and foraminous webs 20 and 44, and both high-density and low-density balls, 46 and 48. A sling constructed from such a kit is easily converted back and forth between the two embodiments of the invention by simply undoing knot 26 and exchanging web 20 for web 44, and vice versa.

The foregoing detailed disclosure of the preferred embodiments of the inventive apparatus 10 and 40 is considered as only illustrative of the preferred embodiments of, and not a limitation upon the scope of, the invention. Those skilled in the art will envision many other possible variations of the structure disclosed herein that nevertheless fall within the scope of the following claims. For example, larger or smaller webs may be used for tossing different-sized balls or other objects, such as water balloons. And, web materials having ribbed or textured surfaces may be employed to permit the user to have more control over the action of a tossed ball, as may be accomplished by imparting english or spin. And, of course, a single web panel may have differently-textured surfaces on its opposed faces. And, alternative uses for the inventive apparatus may later be realized. Accordingly, the scope of the invention should be determined with reference to the appended claims, and not by the examples which have herein been given.

I claim:

1. A sling for tossing and catching an object, comprising:

a. a first elongate, rigid handle having first and second ends;

b. a second elongate, rigid handle having first and second ends;

c. a first cord portion running between a first position on said first handle and a first position on said second handle;

d. a second cord portion running between a second position on said first handle and a second position on said second handle;

e. a flexible web panel;

f. means along a first edge of said web panel for secure, sliding receipt and retention of said first cord portion; and, g. means along a second edge of said web for secure, sliding receipt and retention of said second cord portion.

2. The sling of claim 1, wherein said first and second cord portions are of approximately equal length.

3. The sling of claim 1, further including means for adjusting a cord portion's length.

4. The sling of claim 1, wherein said second cord portion is parallel to said first cord portion.

5. The sling of claim 1, wherein said first and second cord portions are parts of a continuous cord loop.

6. The sling of claim 5, further including means for permitting freely sliding passage of said cord loop from said first position on said first handle to said second position on said first handle to said second position on said second handle to said first position on said second handle, and to said first position on said first handle.

7. The sling of claim 6, wherein said web is generally rectangular and includes first and second parallel side edges and first and second parallel end edges.

8. The sling of claim 7, wherein said first side edge of said web is substantially shorter than said first cord portion, and wherein said second side edge of said web panel is substantially shorter than said second cord portion.

9. The sling of claim 1, wherein said first and second handles are tubular.

10. The sling of claim 9, wherein said first and second cord portions are parts of a continuous cord loop, said cord loop running slidingly through each tubular handle.

11. The sling of claim 10, wherein said first cord portion runs between said first positions on said first and second tubular handles, and wherein said second cord portion runs between said second positions on said first and second tubular handles.

12. The sling of claim 11, wherein when said handles are parallel and drawn apart from one another to the maximum distance said cord loop's length will allow, said first and second cord portions are parallel.

13. The sling of claim 1, wherein said first position on said first handle is at said first end of said first handle, and wherein said first position on said second handle is at said first end of said second handle.

14. The sling of claim 13, wherein said second position on said first handle is at said second end of said first handle, and wherein said second position on said second handle is at said second end of said second handle.

15. The sling of claim 1, wherein the maximum taut width of said web panel is slightly less than the distance between said first cord portion and second cord portion.

16. The sling of claim 1, wherein the distance between said first and second positions on said second handle is equal to the distance between said first and second positions on said first handle.

17. The sling of claim 16, wherein the distances between said first and second positions on said first and second handles is slightly greater than the maximum taut width of said web panel.

18. The sling of claim 16, wherein the distances between said first and second positions on said first and second handles is approximately 4–10% greater than the maximum taut width of said web panel.

19. The sling of claim 16, wherein the distances between said first and second positions on said first and second handles is approximately 0.5 inches greater than the maximum taut width of said web panel.

20. The sling of claim 1, wherein the distance between said first and second positions on said first handle is approximately 8.5 inches; wherein the distance between said first and second positions on said second handle is also approximately 8.5 inches; and, wherein the maximum taut width of said web panel is approximately 8 inches.

21. A sling for tossing and catching an object, comprising:

a. a first elongate, rigid handle;

b. a second elongate, rigid handle;

c. a cord loop;

d. means for engaging said cord loop with said first and second handles such that a first cord loop portion runs between a first position on said first handle and a first position on said second handle, and such that a second cord loop portion runs between a second position on said first handle and a second position on said second handle;

e. a flexible web, said web having first and second parallel side edges and first and second parallel end edges;

f. a first hem along said first side edge of said web, said first hem having said first cord portion running slidingly therethrough and bound therewithin; and, g. a second hem along said second side edge of said web, said second hem having said second cord portion running slidingly therethrough and bound therewithin.

22. The sling of claim 21, wherein said first side edge of said web is substantially shorter than said first cord portion, and wherein said second side edge of said web is substantially shorter than said second cord portion.

23. The sling of claim 21, wherein said cord loop engaging means permits said cord loop to circulate slidingly and freely with respect to said first and second handles.

24. The sling of claim 21, further including means for adjusting said cord loop's length.

25. A sling for tossing and catching an object, comprising:

a. a first elongate, rigid, tubular handle having first and second ends;

b. a second elongate, rigid, tubular handle of the same diameter and length as said first tubular handle, said second tubular handle having first and second ends;

c. a cord loop running slidingly through each tubular handle such that when said handles are parallel and drawn apart from one another to the maximum distance said cord loop's length will allow, a first taut cord portion runs between said first ends of said first and second tubular handles, and a second taut cord portion runs between said second ends of said first and second tubular handles, said second taut cord portion being parallel to said first taut cord portion;

d. a flexible, nonresilient, elongate web, said web having first and second elongate, parallel side edges and first and second shorter, parallel end edges;

e. a first tubular hem along the entirety of the length of said first elongate side edge of said web, said first hem having a sufficient interior dimension for freely sliding receipt of said cord loop, said first tubular hem having said first taut cord portion running therethrough and bound therewithin; and, f. a second tubular hem along the entirety of the length of said second elongate side edge of said web, said second hem having a sufficient interior dimension for freely sliding receipt of said cord loop, said second tubular hem having said second taut cord portion running therethrough and bound therewithin.

26. The sling of claim 25, wherein said first and second handle tubes are slightly longer than said web's maximum taut width.

27. The sling of claim 25, wherein said first and second handle tubes are approximately 0.5 inches longer than said web's maximum taut width.

28. The sling of claim 25, wherein said first side edge of said web is substantially shorter than said first cord portion, and wherein said second side edge of said web is substantially shorter than said second cord portion, whereby when said web is centered between said handles, substantial lengths of cord remain between said web end edges and said handles.

29. A sling-toss game kit, comprising:

a. a first rigid, elongate, tubular handle;

b. a second rigid, elongate, tubular handle, said second handle being of the same diameter and length as said first tubular handle;

c. a cord loop approximately eight to ten times the length of said first handle;

d. a flexible, nonresilient, elongate web, said web having first and second elongate, parallel side edges and first and second shorter, parallel end edges, said first and second side edge each including a tubular hem along the entirety of its respective length, each said tubular hem having a sufficient interior dimension for freely sliding receipt of said cord loop;

e. means for opening said cord loop to expose first and second free cord ends, said means permitting said first free cord end to be threaded through said first handle tube, through said hem of said web's first side edge, through said second handle tube, and through said hem of said web's second side edge, and permitting said first free cord end to be affixed to said second free cord end, thereby closing said cord loop.

30. The kit of claim 29, further including instructions for assembly of said elements of said kit into a sling for tossing a game object.

31. The kit of claim 29, wherein said web comprises a panel of nonforaminous material.

32. The kit of claim 31, further including a ball of a diameter and density similar to a regulation baseball.

33. The kit of claim 29, wherein said web comprises a panel of foraminous material.

34. The kit of claim 33, further including a ball of a diameter similar to a regulation baseball, and less than half a baseball's weight.

* * * * *